US005471275A

United States Patent [19]

Masuda

[11] Patent Number: 5,471,275

[45] Date of Patent: Nov. 28, 1995

[54] PHOTOSENSITIVE MATERIAL PROCESSING APPARATUS

[75] Inventor: Akira Masuda, Kanagawa, Japan

[73] Assignee: Fuji Photo Film Co., Ltd., Kanagawa, Japan

[21] Appl. No.: 318,339

[22] Filed: Oct. 5, 1994

[30] Foreign Application Priority Data

Nov. 29, 1993 [JP] Japan ..... 5-297763

[51] Int. Cl.[6] ..... G03D 3/08

[52] U.S. Cl. ..... 354/321; 354/319; 354/313; 354/341

[58] Field of Search ..... 354/298, 310, 354/313, 319–323, 324, 340, 339, 344; 226/181, 189

[56] References Cited

U.S. PATENT DOCUMENTS 5,212,512 5/1993 Shiota ..... 354/319

5,231,439 7/1993 Takahashi et al. ..... 354/313

5,311,237 5/1994 Kawada et al. ..... 354/341

FOREIGN PATENT DOCUMENTS 4-365042 12/1992 Japan ..... 354/313

*Primary Examiner*—D. Rutledge

*Attorney, Agent, or Firm*—Sughrue, Mion, Zinn, Macpeak & Seas

[57] ABSTRACT

A photosensitive material processing apparatus in which, before a photosensitive material is processed, a leading end portion of the photosensitive material is cut by a cutter in a configuration which is suitable for smooth conveying of the photosensitive material within a processing section. When it detected that the leading end portion is of a configuration which is not suitable for smooth processing, processing is stopped. Accordingly, damage to the photosensitive material within the photosensitive material processing apparatus is prevented.

20 Claims, 9 Drawing Sheets

PHOTOSENSITIVE MATERIAL PROCESSING APPARATUS

BACKGROUND OF THE INVENTION

1. Field of the Invention

The present invention relates to a photosensitive material processing apparatus provided with guide grooves which are provided along the sides of a predetermined conveying path and which guide a photosensitive material along the conveying path.

2. Description of the Related Art

After an image has been exposed on a photosensitive material such as a photographic film (e.g., a negative film), the negative film is processed by a photosensitive material processing apparatus such as an automatic developing apparatus or the like. In the automatic developing apparatus, the negative film, on which the image has been exposed, is curved and conveyed through processing tanks such as a developing tank, a fixing tank, washing tanks and the like. The negative film is submerged in processing solutions such as developing solution, fixing solution, washing water and the like in the respective tanks so as to be processed.

The rigidity, along the conveying direction, of the negative film which is processed by such an automatic developing apparatus is relatively high. Therefore, a leader is provided at the leading end of the negative film and is conveyed along a predetermined conveying path. The negative film is pulled by the leader so as to be smoothly guided and conveyed without deviating from the conveying path.

When the leader is attached to the leading end of the negative film, the negative film and the leader must be joined such that they do not come apart within the apparatus. Further, removing the leader from the leading end of the negative film is a complex operation. Therefore, there exists a so-called leaderless automatic developing apparatus in which guide grooves are provided at both transverse direction sides of the conveying path such that the end portions of the negative film are fit with play into the guide grooves and are guided along the conveying direction by the guide grooves. In this way, the negative film can be conveyed without a leader being provided at the leading end thereof.

The negative film which is processed by a leaderless automatic developing apparatus is processed while being conveyed within the apparatus with both transverse direction sides thereof being fit with play in the guide grooves. There is no need to provide a leader because both transverse direction sides of the negative film are guided along the conveying path by the guide grooves.

However, the leading end portion of the negative film processed at the automatic developing apparatus is usually cut substantially straight so as to be orthogonal to both transverse direction ends of the negative film. When such a negative film is curved along the longitudinal direction, because both transverse direction ends of the negative film are held down by the guide grooves, the transverse direction intermediate portion of the negative film bulges outwardly in the direction of the radius of curvature due to the rigidity of the negative film and its tendency to curl.

As illustrated in FIGS. 9A and 9B, both conveying path transverse direction ends of a negative film 12, which is being conveyed in the direction of arrow B (shown only in FIG. 9A), are guided by guide grooves 72. When the leading end portion of the negative film 12 reaches a curved portion along the periphery of a roller 45A, the transverse direction end portions are held down by the guide grooves 72, but the central portion of the leading end of the negative film 12 bulges due to the rigidity of the negative film 12 (see FIG. 9B).

In the automatic developing apparatus, when the leading end of the negative film 12 bulges at a curved portion, the leading end portion of the negative film 12 may be rolled upward or folded over by the roller provided at the outer side of the curved portion, such that the negative film 12 is damaged. Further, because the negative film 12 bulges at the curved portion, the negative film 12 may deviate from the conveying path such that smooth processing cannot be carried out. In particular, at a crossover portion which delivers the negative film 12 to an adjacent processing tank, it is necessary to squeeze out the processing solution adhering to the negative film 12. Therefore, rollers must be provided so as to oppose each other at the curved portions, and it is easy for the negative film 12 to be conveyed poorly.

SUMMARY OF THE INVENTION

In view of the aforementioned, an object of the present invention is to provide a photosensitive material processing apparatus which is a so-called leaderless photosensitive material processing apparatus and in which good conveying of a photosensitive material, which is being processed, can be ensured and the photosensitive material can be processed smoothly without being damaged.

The photosensitive material processing apparatus relating to the first aspect of the present invention includes a roller which applies conveying force to a photosensitive material, and a conveying path in which the photosensitive material is conveyed by guide grooves while being curved by the guide grooves. The guide grooves are provided at the transverse direction sides of the conveying path. The transverse direction end portions of the photosensitive material are fit with play into the guide grooves and are guided thereby. The photosensitive material processing apparatus of the first aspect features a cutter which, before processing of the photosensitive material begins, cuts the photosensitive material such that at least one transverse direction edge thereof projects further in the conveying direction of the photosensitive material than the conveying path transverse direction central portion thereof.

The photosensitive material processing apparatus relating to the second aspect of the present invention includes a roller which applies conveying force to a photosensitive material, and a conveying path in which the photosensitive material is conveyed by guide grooves while being curved by the guide grooves. The guide grooves are provided at the transverse direction sides of the conveying path. The transverse direction end portions of the photosensitive material are fit with play into the guide grooves and are guided thereby. The photosensitive material processing apparatus of the second aspect features a detecting device which detects a configuration of a leading end of the photosensitive material before processing of the photosensitive material begins, and a processing permitting device which permits processing of the photosensitive material only when it is determined, from results of detection by the detecting device, that at least one conveying path transverse direction edge of the leading end of the photosensitive material projects further in a conveying direction of the photosensitive material than a conveying path transverse direction central portion thereof.

In the photosensitive material processing apparatus of a first aspect of the present invention, the non-image portion of the leading end of the photosensitive material which has been inserted into a film loading section is cut by the cutter. Thereafter, the conveying of the photosensitive material is started. At this time, the leading end is cut by the cutter in a configuration in which one transverse direction end portion of the photosensitive material projects further than the transverse direction central portion thereof.

By cutting the leading end of the photosensitive material in tile above-described manner, even if the transverse direction intermediate portion of the photosensitive material bulges when the leading end of the photosensitive material has reached a curved portion of the conveying path, because the transverse direction intermediate portion of the leading end of the photosensitive material is cut down the actual bulging is reduced and the transverse direction intermediate portion is guided in the conveying direction by the roller even if it abuts the peripheral surface of the roller. Even if the bulging portion of the leading end of the photosensitive material abuts the peripheral surface of the roller, the leading end portion of the photosensitive material is prevented from coming out of the guide grooves, and the photosensitive material can be conveyed smoothly in the photosensitive material processing apparatus.

In the photosensitive material processing apparatus of the second aspect of the present invention, processing of the photosensitive material is started only when the leading end of the photosensitive material, which end is detected by the detecting device, is a predetermined configuration. If the configuration of the leading end of the photosensitive material is such that at least one transverse direction end portion projects further than the transverse direction central portion, the photosensitive material is not conveyed poorly even when delivered into the apparatus.

The configuration of the leading end of the photosensitive material which is applicable to the present invention is a configuration in which one or both transverse direction ends project further than the transverse direction central portion. In particular, if both transverse direction ends project further than the transverse direction central portion, the transverse direction end portions do not slip out of the guide grooves even if the transverse direction intermediate portion of the photosensitive material protrudes toward the outer side of the curved conveying path.

As described above, in the photosensitive material processing apparatus of the present invention, the leading end portion of the photosensitive material is replaced, due to the cutter, by a configuration which is suitable for smooth progress of the processing. Therefore, the photosensitive material is not damaged within the processing apparatus. Further, when the detecting device detects a photosensitive material whose leading end portion is not of a configuration which permits smooth processing, processing is stopped. Accordingly, damage to the photosensitive material can be prevented.

BRIEF DESCRIPTION OF THE DRAWINGS

FIGS. 5A and 5B illustrate variant examples of configurations of a leading end of the negative film, wherein FIG. 5A is a schematic plan view illustrating a configuration of the leading end portion of the negative film, and FIG. 5B is a schematic plan view illustrating a state in which both edges of the negative film are fit with play in guide grooves.

DESCRIPTION OF THE PREFERRED EMBODIMENTS

The embodiments of the present invention will be described hereinafter with reference to the appended drawings.

Figure 1:
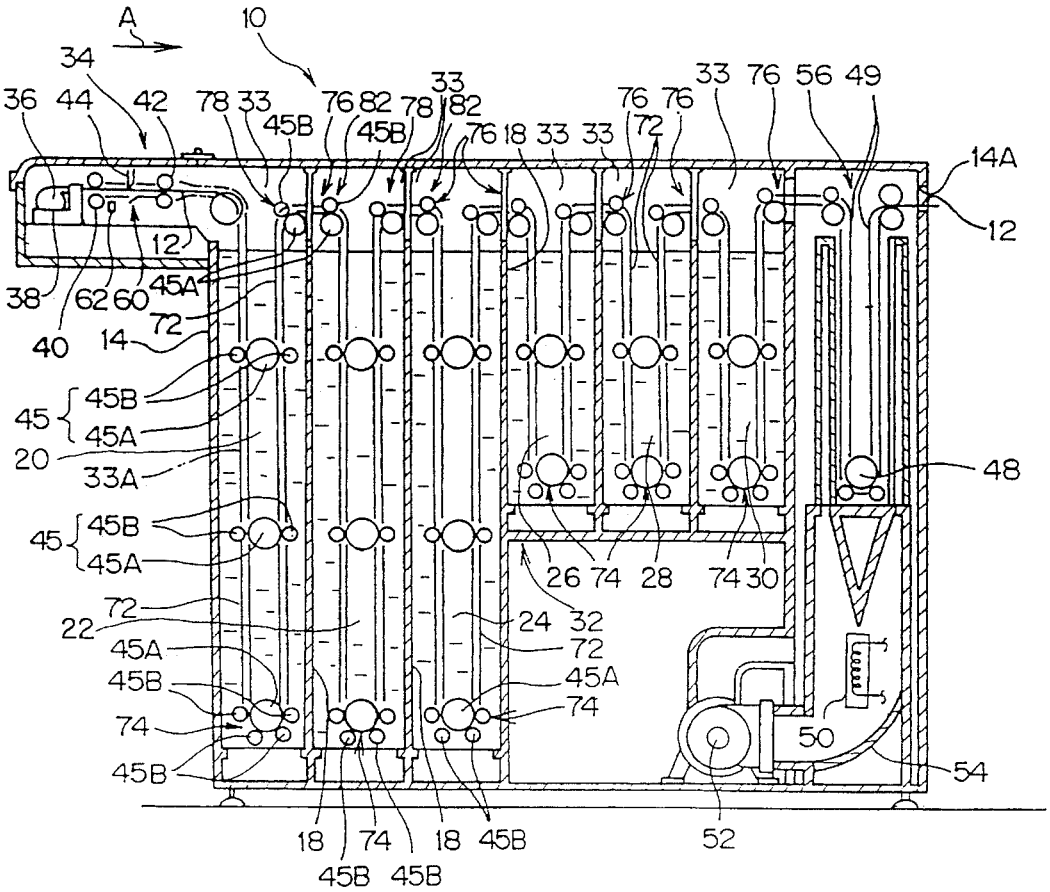
FIG. 1 is a schematic structural view of an automatic developing apparatus to which a first embodiment of the present invention is applied.

FIG. 1 illustrates an automatic developing apparatus 10 to which the present embodiment is applied. The outer side of the automatic developing apparatus 10 is enclosed by a frame 14 such that the interior portion of the automatic developing apparatus 10 is shielded from light. Further, a plurality of supporting legs are provided at the bottom portion of the frame 14 so that the automatic developing apparatus 10 can be supported on a floor surface.

A plurality of vertical walls 18 are provided so as to rise from the bottom portion of the frame 14 such that a developing tank 20, a bleaching tank 22, a fixing tank 24, washing tanks 26, 28, and a stabilizing tank 30 are formed. Processing solutions are stored in the respective tanks. (Hereinafter, the term "processing section 32" will be used as a generic name for the tanks 20, 22, 24, 26, 28 and 30.)

A film loading section 34 is provided at the left side in FIG. 1 of the processing section 32. A holding portion 38, into which a magazine 36 is loaded and which holds the magazine 36, is provided in the film loading section 34. The leading end portion of a negative film 12 is pulled out from the magazine 36, which is loaded in and held at the holding portion 38, and is nipped and conveyed (in the direction of arrow A in FIG. 1) by pairs of rollers 40, 42. In the negative film 12 which is used as the photosensitive material in the present embodiment, a photosensitive layer is formed on the surface of a supporting body such as polyethylene terephthalate (PET) or the like.

A pair of guide grooves 60, which guide the transverse direction end portions of the negative film 12 along the conveying direction, is provided between the pairs of rollers 40, 42. Further, a film sensor 62 and a cutter 44 are also disposed between the pairs of rollers 40, 42.

Figure 2:
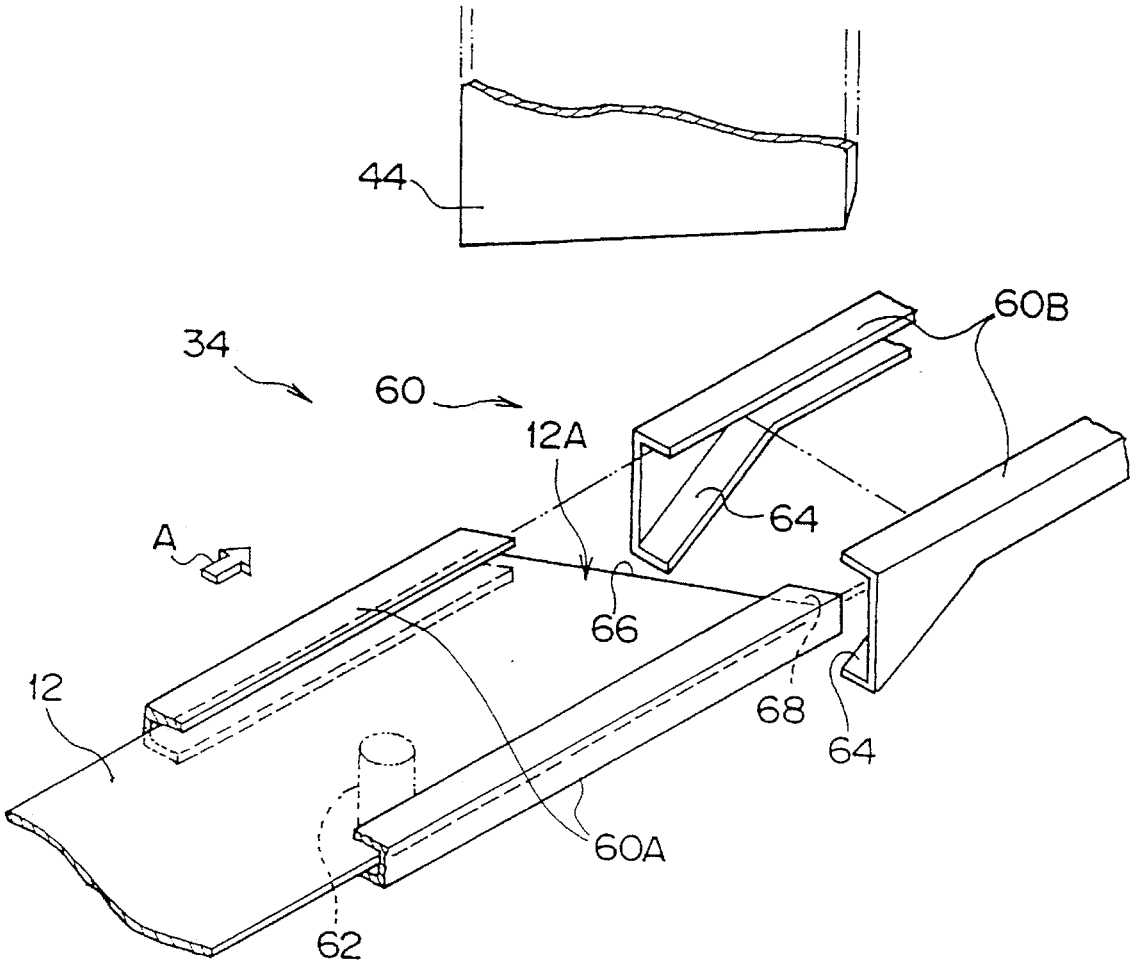
FIG. 2 is a schematic perspective view illustrating a vicinity of a cutter of the automatic developing apparatus of the first embodiment.

As illustrated in FIG. 2, the cutter 44 is disposed at an angle so as to intersect the negative film 12 at a predetermined angle with respect to the conveying path transverse direction thereof. Further, the guide grooves 60 which are disposed between the pairs of rollers 40, 42 are each divided into an upstream guide groove 60A and a downstream guide groove 60B, which are disposed upstream and downstream in the conveying direction, respectively, of the position at which the cutter 44 is disposed. One off the guide grooves 60A projects further along the conveying direction than the other guide groove 60A in accordance with the angle of inclination of the cutter 44. A guide portion 64 is provided at each of the downstream guide grooves 60B at the end portion of the downstream guide groove 60B separated from the upstream guide groove 60A. The guide portion 64 is oriented upwardly from the upstream side to the downstream side thereof.

When the negative film 12, which is nipped between and conveyed by the pair of rollers 40, is delivered out from the guide grooves 60A, the negative film 12 is guided by the guide portions 64 so as to reach the guide grooves 60B. Here, the conveying of the negative film 12 is temporarily stopped at a predetermined time after the time when the leading end of the negative film 12 is detected by the film sensor 62. At this time, the non-image portion of the leading end portion of the negative film 12 is positioned between the guide grooves 60A, 60B. At this position, the cutter 44 is operated so that the leading end portion of the negative film 12 is cut in a predetermined configuration. The cut leading end of the negative film 12 falls downward from the guide portions 64 due to its own weight.

Figure 3A:
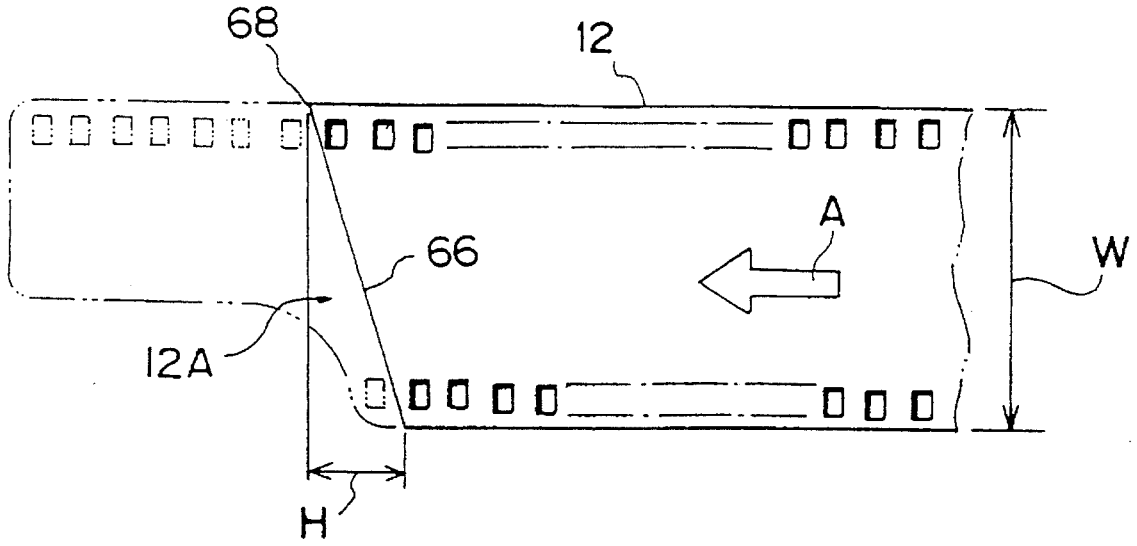
FIG. 3A is a schematic plan view illustrating a configuration of a leading end portion of a negative film which has been cut by the cutter.

FIG. 3A illustrates the leading end portion of the negative film 12 cut by the cutter 44. A leading end portion 12A in the conveying direction (the direction of arrow A) of the negative film 12 is shaped such that one transverse direction end thereof forms a leading end 68 which projects Further in the conveying direction than a transverse direction intermediate portion 66.

The conditions of inclination (e.g., the angle of inclination or the like) of the leading end portion 12A of the negative film 12 can be set in accordance with the transverse dimension of the negative film 12, the rigidity of the PET which is the supporting body, the size of the rollers forming the conveying path, the magnitude of curvature of the conveying path and the like. When, for example, the transverse dimension W of the negative film 12 is 35 mm (35 mm film), the dimension of the cut portion, i.e., the difference H between the transverse direction ends, may be about 5 to 20 mm. Further, it is preferable to cut the negative film 12 in a shape such that the perforations at both edges are not cut, so that there is no deterioration in the strength of the transverse direction ends of the negative film 12.

Figure 3B:
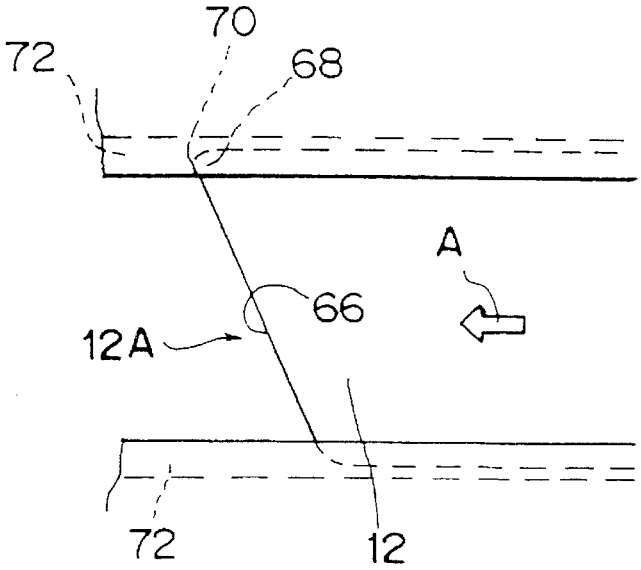
FIG. 3B is a schematic plan view illustrating a state in which both edges of the negative film are fit with play in guide grooves.

As illustrated in FIG. 3B, a predetermined rounded portion 70 is formed at the leading end 68 of the negative film 12. The rounded portion 70 prevents the leading end 68 from catching on the joints off the guide grooves and the like and allows the negative film 12 to be conveyed smoothly when the negative film 12 is guided within the processing section 32. It is preferable that the rounded portion 70 is set to a size such that the leading end which projects the furthest in the conveying direction does not protrude out from the guide groove.

The configuration of the leading end portion of a conventional negative film 12 is illustrated by the imaginary lines in FIG. 3A. The leading end portion 12A of the negative film 12 which is cut by the cutter 44 is of a shape in which the portion represented by the imaginary lines is cut off. Further, the cutter 44 is operated when substantially the entire negative film 12 is pulled out from the magazine 36 so that the trailing end of the drawn-out negative film 12 is cut and separated from the magazine 36.

As illustrated in FIG. 1, a processing rack 33 is disposed in each of the processing tanks of the processing section 32. Each processing rack 33, with the exception of the upper portion thereof, is submerged in a processing solution.

Conveying rollers 45 are formed by a large diameter roller 45A, or by the large diameter roller 45A and small diameter rollers 45B which oppose the large diameter roller 45A. The conveying rollers 45 are disposed in the processing rack 33 in a vicinity of the liquid surface, in a vicinity of the bottom portion, and at intermediate portions thereof. Further, pairs of guide grooves 72 which guide the transverse direction end portions of the negative film 12 are disposed between the respective conveying rollers 45 (only ones of the pairs of guide grooves 72 are illustrated in FIG. 1).

Conveying rollers 74 are formed such that a plurality of small diameter rollers 4SB are disposed around the large diameter roller 45A which is disposed at the bottom portion of the processing rack 33, and the guide grooves 72 are formed at the axial end portions of the small diameter rollers 45B. The conveying rollers 74 guide the negative film 12 along the peripheral surface of the large diameter roller 45A in a stable state and reverse the conveying direction of the negative film 12.

As illustrated in FIG. 1, an exit-side conveying roller 78 and guide grooves 80A and an entrance-side conveying roller 82 and guide grooves 80B oppose each other at the upper portions of the processing racks 33, i.e., at adjacent processing racks 33 of a crossover portion 76 above the liquid surfaces of the processing solutions. At the conveying rollers 78, the Large diameter roller 45A and the small diameter roller 45B oppose each other and are inclined at a predetermined angle. The conveying rollers 78 change the conveying direction off the negative film 12 which has been delivered out from the processing solution, and convey the negative film 12 along a substantially horizontal direction out toward the adjacent conveying rollers 82. At this time, the processing solution adhering to the surfaces of the negative film 12 is squeezed therefrom by the large diameter roller 45A and the small diameter roller 45B and is recovered within the tank.

At the conveying rollers 82, the large diameter roller 45A and the small diameter roller 45B are arranged substantially vertically, i.e., with the small diameter roller 45B substantially directly above the large diameter roller 45A. The conveying rollers 82 convey the leading end portion of the negative film 12 which was conveyed in by the conveying rollers 78. At this time, the negative film 12 is oriented downwardly by the guide grooves 80B, which are provided along the periphery of the large diameter roller 45A, and is conveyed into the processing solution.

In this way, the negative film 12 is conveyed, by the processing racks 33, within the respective processing tanks and between adjacent processing tanks while being curved. When the negative film 12 is discharged from the stabilizing tank 30 which is the final tank, the negative film 12 is transferred to a drying section 56.

A warm air supplying means formed by a heater 50 and an air blower 52 is provided beneath the stabilizing tank 30. The warm air generated by the warm air supplying means is sent as drying air into the drying section 56 via a duct 54. In the drying section 56, the negative film 12 which has been delivered in from the processing section 32 is oriented downwardly by guide grooves 49 and is conveyed downwardly. Thereafter, the conveying direction off the negative film 12 is reversed by a turn roller 48 so that the negative film 12 is directed upward. The negative film 12 is guided by the guide grooves 49 to a discharge opening 14A, and is sent out to the exterior of the automatic developing apparatus 10. At this time, the negative film 12 which is being conveyed within the drying section 56 is exposed to the warm air supplied from the warm air supplying means and is dried.

Next, operation of the present embodiment will be described.

In the automatic developing apparatus 10 of the present embodiment, the negative film 12, which has already been exposed and which is in the magazine 36 loaded in the magazine loading section 34, is pulled out and is sent into the processing portion 32. At this time, when the leading end portion of the negative film 12 pulled out from the magazine 36 is delivered out from the pair of rollers 40, the leading end portion is guided by the guide grooves 60 and passes above the film sensor 62. When the film sensor 62 detects the passing of the leading end of the negative film 12, the automatic developing apparatus 10 temporarily stops the conveying of the negative film 12 so that the leading end portion of the negative film 12 is positioned so as to oppose the cutter 44, and the negative film 12 is cut by the cutter 44. The leading end portion 12A of the negative film 12 is cut at an angle such that one transverse direction end thereof projects in the conveying direction.

Thereafter, the conveying of the negative film 12 begins again, and the negative film 12 is delivered into the processing section 32. Here, when substantially the entire negative film 12 is pulled out from the magazine 36, the trailing end portion of the negative film 12 is cut by the cutter 44 so that the negative film 12 and the magazine 36 are separated.

In the processing section 32, the negative film 12 is curved and conveyed by the processing racks 33 disposed in the respective processing tanks, and is submerged and processed successively in the processing solutions. The negative film 12 which has been processed in the processing section 32 is sent into the drying section 56. In the drying section 56, the negative film 12 is exposed to the warm air and is subject to drying processing, and is then discharged to the exterior of the automatic developing apparatus 10.

Figure 4:
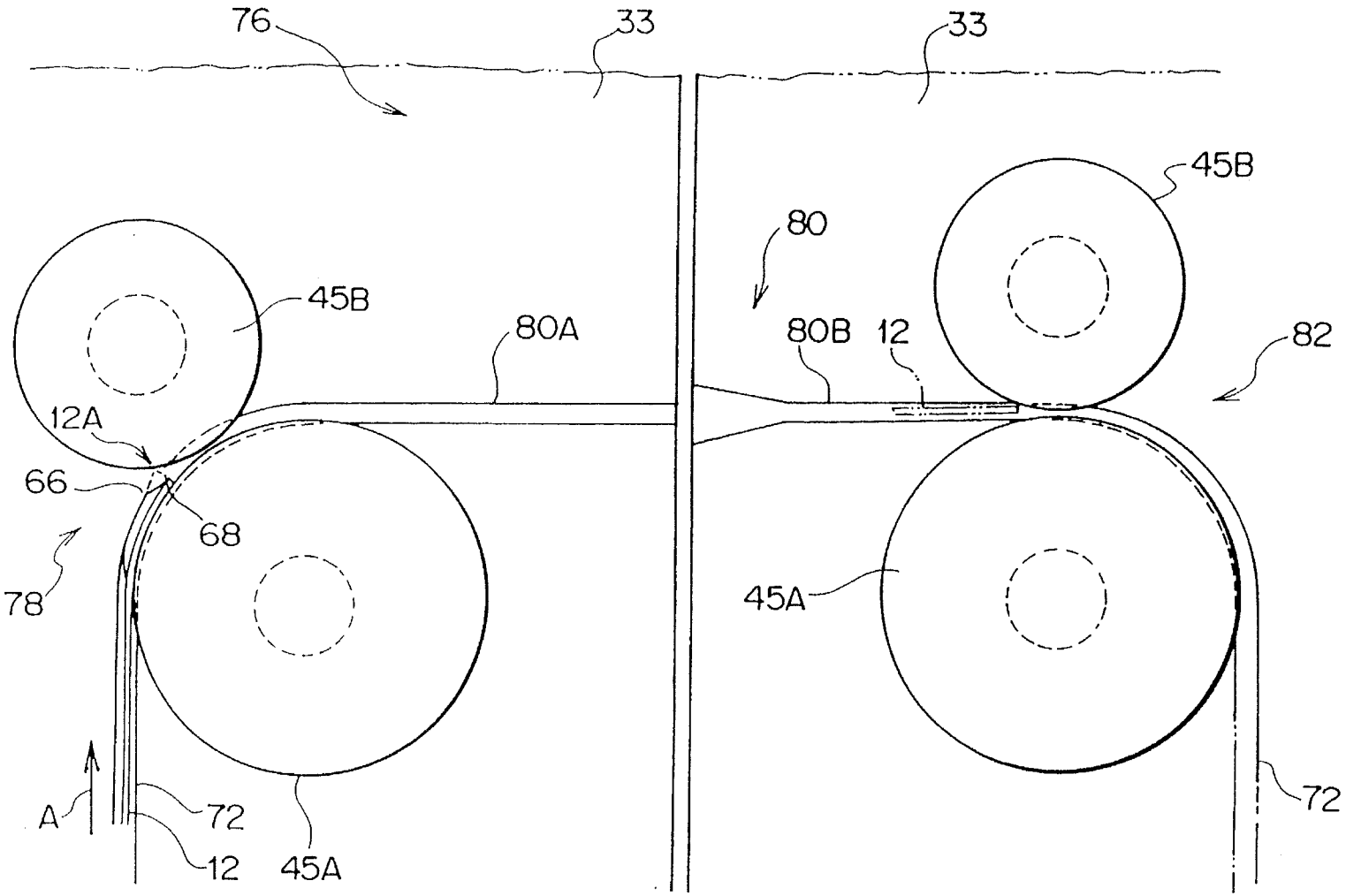
FIG. 4 is a schematic structural view of a crossover portion.

At the automatic developing apparatus 10, the negative film 12 is sent into the processing section 32 in which the curved conveying path of the negative film 12 is formed in the processing racks 33 by the guide grooves 72 and the conveying rollers 45, 74. Explanation will now be given, with reference to FIG. 4, of the negative film 12 passing through the crossover portion 76 in which the curved conveying path of the negative film 12 is formed as shown in FIG. 4.

In the crossover portion 76, the leading end portion 12A of the negative film 12 is guided from the interior of the processing tank to the nip between the large diameter roller 45A and the small diameter roller 45B (the conveying rollers 78) by the guide grooves 72. At this time, because the leading end portion 12A of the negative film 12 is guided to the nip between the conveying rollers 78 while being curved by the guide grooves 72, a transverse direction central portion of the leading end portion 12A bulges toward the outer side of the curvature of the conveying path due to the rigidity of the negative film 12 when the leading end portion 12A begins to curve just before the negative film comes in contact with the small diameter roller 45B.

Here, because the leading end portion 12A of the negative film 12 is cut at a predetermined angle along the transverse direction, the leading end 68 which is the end which projects the furthest in the conveying direction is guided to the nip between the conveying rollers 78 by the guide grooves 72. However, the intermediate portion which is the intermediate portion of the leading edge of the negative film 12 in the transverse direction thereof, lags slightly behind the leading end 68, and approaches the peripheral surface of the small diameter roller 45B. At this time, at the leading end portion 12A of the negative film 12, the transverse direction intermediate portion which is adjacent to the leading end 68 bulges the most. However, because the portion adjacent to the leading end 68 has been cut off (as illustrated by the imaginary line in FIG. 4), the amount of bulging when the leading end portion 12A of the negative film 12 curves is suppressed.

In this state, the leading end portion 12A of the negative film 12 approaches the peripheral surface of the small diameter roller 45B, and the amount of bulging at the intermediate portion 68 is small. Therefore, when the leading end portion 12A is guided by the small diameter roller 45B to the nip between the small diameter roller 45B and the large diameter roller 45A and abuts the peripheral surface of the small diameter roller 45B, the curved portion is not rolled upward or folded over or the like.

At the crossover portion 76, the conveying direction of the negative film 12, which has been conveyed upwardly from the upstream processing tank, is reversed. Here, it is necessary to convey the negative film 12 into the downstream processing tank, and to squeeze out the processing solution from the upstream processing tank which has adhered to the surfaces of the negative film 12. To this end, it is necessary for the negative film 12 to be curved while it is being nipped by the conveying rollers 78. At this time, because the leading end portion 12A of the negative film 12 has been cut at an angle with respect to the transverse direction, the amount of bulging of the leading end portion 12A of the negative film 12 at the curved portions of the conveying path can be held down to a small amount. Accordingly, damage due to the leading end portion 12A of the negative film 12 being rolled upward or folded over by the small diameter roller 45B disposed at the curved portion of the conveying path can be prevented.

In the automatic developing apparatus 10, the negative film 12 is processed while being guided and conveyed by pairs of guide grooves while conveying force is applied to the negative film 12 by rollers. In such an automatic developing apparatus 10, the passability of the negative film 12 at the curved portions of the conveying path is extremely good although no film leader is provided at the leading end of the negative film 12. Accordingly, the negative film 12 can be conveyed smoothly. Further, the rounded portion 70 provided at the leading end 68 of the negative film 12 can prevent the transverse direction leading end of the negative film 12 from catching on the joints of the guide grooves 80A, 80B when the leading end 68 is being conveyed between the guide grooves 80A of the upstream processing rack 33 and the guide grooves 80B of the downstream processing rack 33 at the crossover portion Any of various configurations may be used for the configuration of the leading end portion of the negative film 12 cut by the cutter 44, i.e., the shape in which the cutter 44 cuts the negative film 12.

Figure 5A:
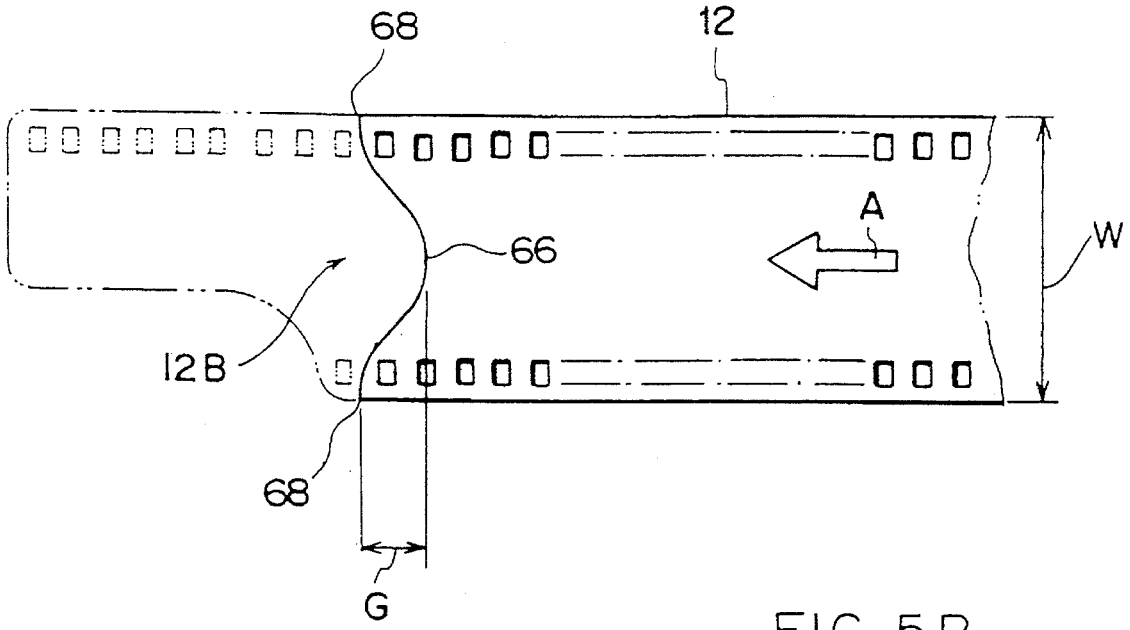
Figure 5B:
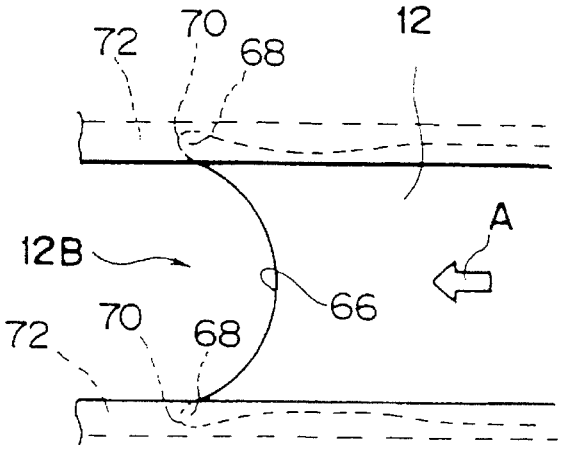

For example, as illustrated in FIG. 5A and FIG. 5B, the configuration of a leading end portion 12B, which is formed as a circular arc shaped concave portion, may be used for the leading end of the negative film 12. In this case as well, it is preferable to cut the negative film 12 in a shape such that the perforations at both edges are not cut, so that there is no deterioration in the strength of the edge portions. The leading end portion 12B of the negative film 12 is shaped such that the region between the leading ends 68 of the negative film 12 at both conveying path transverse direction sides, at which leading ends 68 the rounded portions 70 are formed, is cut out in a circular arc shape so as to form the intermediate portion 66 which recedes in a direction opposite the conveying direction (the direction of arrow A is the conveying direction) from both of the leading ends 68. At the leading end portion 12B, when the transverse dimension W of the negative film 12 is 35 mm, the difference G, along the conveying direction. between the leading end 68 and the intermediate portion 66 is about 1 to 10 mm. As described above, it is preferable that this dimension is set by taking various conditions into consideration such as the configuration of the conveying path, the rigidity of the negative film 12 and the like.

In this way, even if the negative film 12, at which the circular arc shaped leading end portion 12B is formed, is delivered in between the conveying rollers 78 while being curved by the guide grooves 72, the leading end portion 12B can be smoothly conveyed between the small diameter roller 45B and the large diameter roller 45A and can be smoothly delivered out by the conveying rollers 78, in the same way as the previously-described leading end portion 12A of the negative film 12.

At this time, when the intermediate portion 86 of the leading end portion 12B of the negative film 12 bulges, both transverse direction ends are pulled in a direction of being pulled out from the guide grooves 72. However, because the leading ends 68 which fit into the guide grooves 72 are provided at both transverse direction sides, each of the leading ends 68 can be restrained From coming out of the guide groove 72 by the other leading end 68. Both transverse direction ends of the negative film 12 can be reliably prevented From coming out of the guide grooves 72, and the conveying of the negative film 12 is more reliable.

A second embodiment of the present invention will be described hereinafter. The basic structure of the second embodiment is the same as that of the first embodiment. Accordingly, the same parts are denoted by the same reference numerals and description thereof is omitted.

Figure 6A:
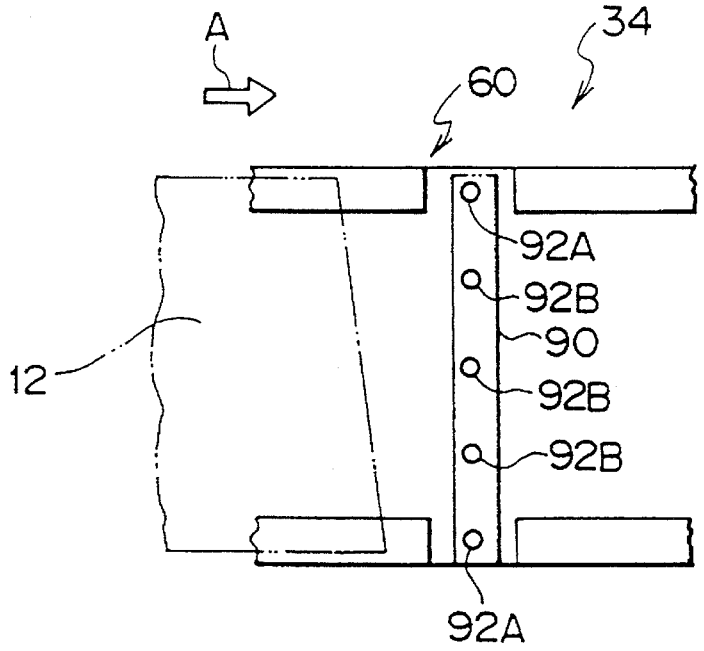
FIG. 6A is a schematic plan view illustrating placement of a film sensor applied to a second embodiment.
Figure 6B:
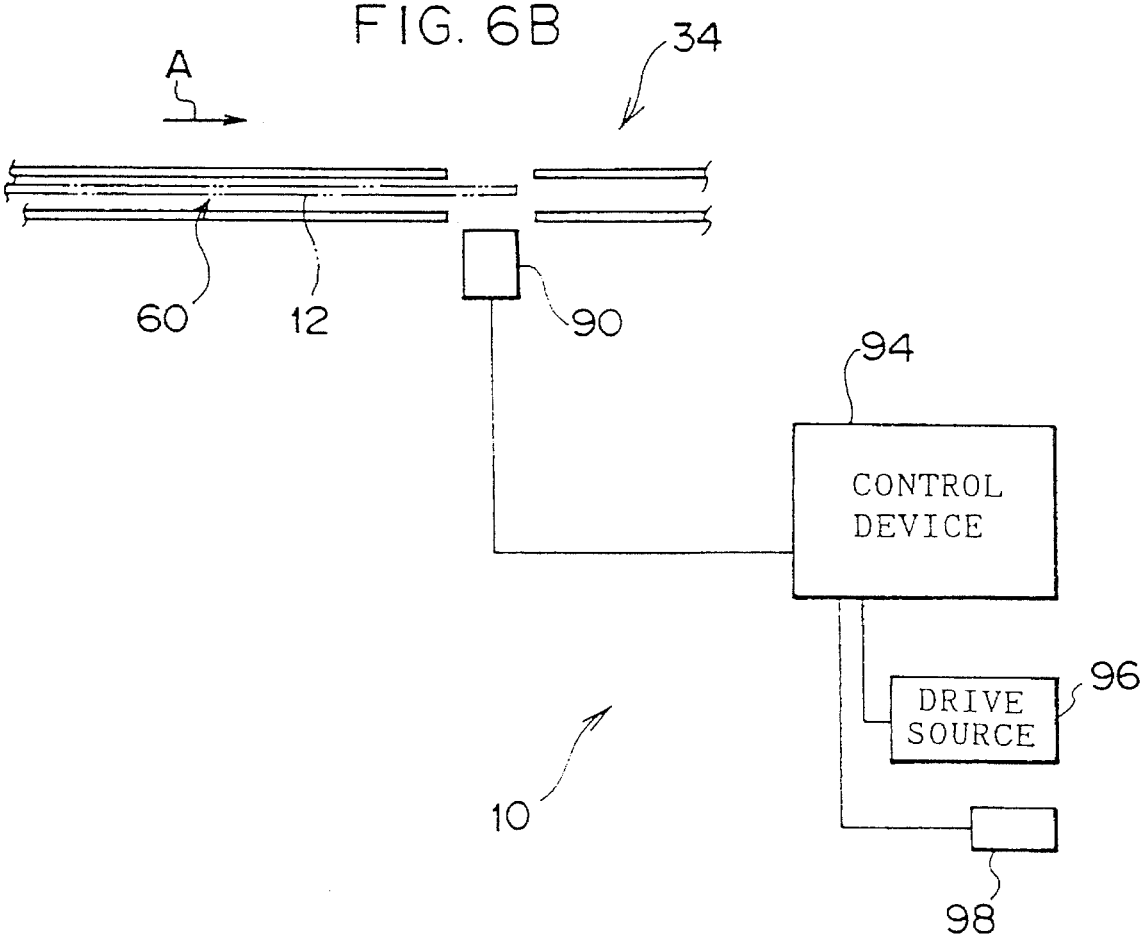
FIG. 6B is a schematic block view illustrating the connection of the film sensor.

FIGS. 6A and 6B illustrate the placement of a film sensor 90 which is provided at the magazine loading section 34 of the automatic developing apparatus 10. The film sensor 90 is provided in place of the film sensor 62 of the first embodiment. Further, in the present embodiment, an ordinary cutter (unillustrated) which cuts and separates the trailing end of the negative film 12 from the magazine 36 when substantially the entire negative film 12 has been pulled out from the magazine 36 may be used in place of the cutter 44.

As shown in FIG. 6A, the portions of the guide grooves 60 which portions are disposed at the film sensor 90 are cut, and sensors 92A which oppose the transverse direction end portions of the negative film 12 are disposed at these cut portions. A plurality of sensors 92B are disposed between the sensors 92A. The sensors 92B oppose a plurality of regions of tile transverse direction intermediate portion of the negative film 12.

As illustrated in FIG. 6B, the film sensor 90 is connected to a control device 94 off the automatic developing apparatus 10. The control device 94 controls operation of the processing section 32 and the drying section 56 of the automatic developing apparatus 10. The control device 94 is connected to a drive source 96 which drives the large diameter rollers 45A of the respective processing racks 33.

At the control device 94, when the leading end of the negative film 12 which has been pulled out from the magazine 36 is detected by the film sensor 90, processing of the negative film 12 at the processing section 32 becomes possible. At this time, at the control device 94, the approximate configuration of the leading end of the negative film 12 which has been delivered into the processing section 32 is verified by the plurality of sensors 92A, 92B which are arranged along the transverse direction of the negative film 12. If the approximate configuration of the leading end is a predetermined configuration, the negative film 12 is conveyed into the processing section 32. If the approximate configuration of the leading end is a shape other than the predetermined configuration, the driving of the drive source 96 is stopped so that the negative film 12 is not delivered into the processing section 32. Further, a notification means, such as a warning device 98 or the like connected to the control device 94, gives notice of the insertion of the negative film 12 whose leading end configuration is not suitable For smooth processing at the automatic developing apparatus 10.

Figure 7:
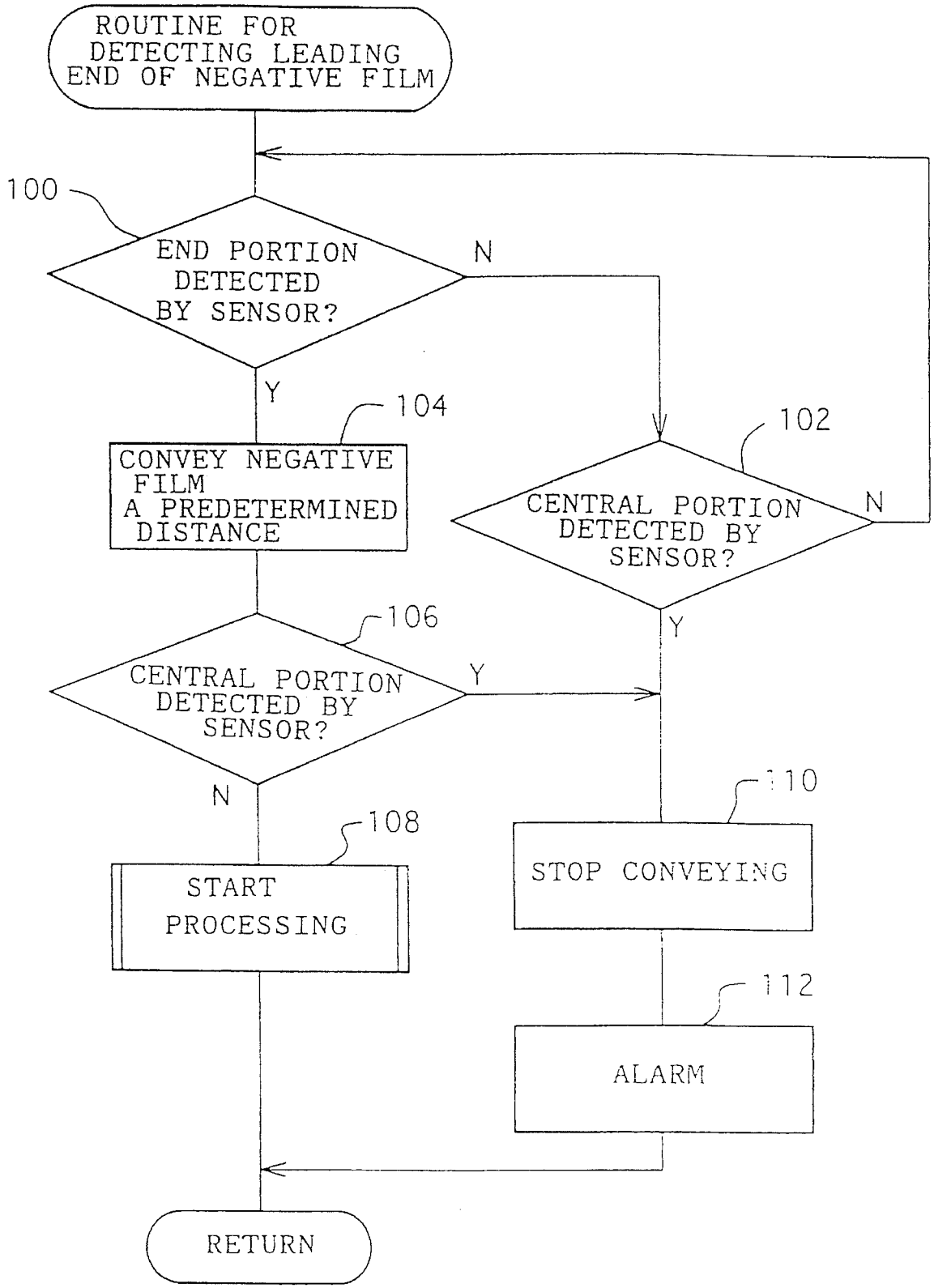
FIG. 7 is a flowchart for detecting a leading end of a film relating to the second embodiment.

FIG. 7 illustrates a flowchart for detecting the leading end of the negative film and the configuration of the leading end. This detection is effected before the processing of the negative film 12 which has been pulled out from the magazine 36. The flowchart is implemented when the negative film 12 is pulled out from the magazine 36.

In the first step 100, the sensors 92A of the film sensor 90 verify whether either of the transverse direction leading ends of the negative film 12 has passed. If it is verified that neither of the transverse direction leading ends has passed, in step 102, it is verified whether any of the sensors 92B has detected the passing of the transverse direction intermediate portion of the negative film 12.

Here, if either of the transverse direction end portions of the negative film 12 is detected by the sensor 92A before the transverse direction intermediate portion of the negative film 12 is detected by the sensor 92B, the process proceeds to step 104 where the negative film 12 is conveyed a predetermined distance. Thereafter, in step 106, if the transverse direction intermediate portion is not detected by the sensor 92B while the negative film 12 is being conveyed the predetermined distance (i.e., if the answer to the determination in step 106 is "No"), the process moves to step 108 where processing of the negative film 12 at the processing section 32 begins.

In contrast, the process moves to step 110 if any of the sensors 92B detect the passing of the transverse direction intermediate portion of the negative film 12 before the sensor 92A detects a transverse direction end portion of the negative film 12 (i.e., if the answer to the determination in step 102 is "Yes"), or if the sensor 92B detects the passing of the transverse direction intermediate portion while the negative film 12 is being conveyed the predetermined distance after at least one of the transverse direction end portions has been detected by the sensor 92A (i.e., if the answer to the determination in step 106 is "Yes"). In step 110, operation of the drive source 96 is stopped, and in step 112, the warning device 98 is operated and notice is given of the stopping of the drive source 96 by an alarm or the like.

Namely, when the sensor 92A is activated first, the configuration of the leading end of the negative film 12 is a configuration corresponding to either of the shapes illustrated in FIG. 3A and FIG. 5A. Smooth processing of such a negative film 12 is possible even if the negative film 12 is conveyed while being curved at the automatic developing apparatus 10. However, if the sensor 92B is activated first or if the sensor 92A and the sensor 92B are activated simultaneously, it is determined that the configuration of the leading end of the negative film 12 is a configuration which is not suitable for smooth conveying at the automatic developing apparatus 10.

In this way, only negative films 12 having leading end configurations which allow for smooth processing are processed. Processing of negative films 12 having leading end configurations other than those which allow for smooth processing is prohibited. Accordingly, damage to the negative film 12 within the apparatus can be prevented, and smooth processing can always be promoted. In the above described flowchart, the sensors 92A, 92B detect which of the transverse direction end portion and the transverse direction intermediate portion of the negative film 12 projects in the conveying direction. However, the configuration of the negative film 12 may be detected in even greater detail so as to judge whether the negative film 12 is suitable for processing.

In the second embodiment, processing of negative films 12 of configurations other than the predetermined configuration is stopped. However, the cutter 44 used in the first embodiment may be applied to the second embodiment such that when the leading end off the negative film 12 is not a predetermined configuration, the configuration of the leading end may be made by the cutter 44 into a configuration which allows for smooth processing at the automatic developing apparatus 10.

further, the detecting device is not limited to the film sensor 90 which is formed by the sensors 92A, 92B. Any detecting device is applicable provided that the device detects whether at least one of the transverse direction ends of the negative film 12 projects further in the conveying direction than the transverse direction intermediate portion.

Figure 8:
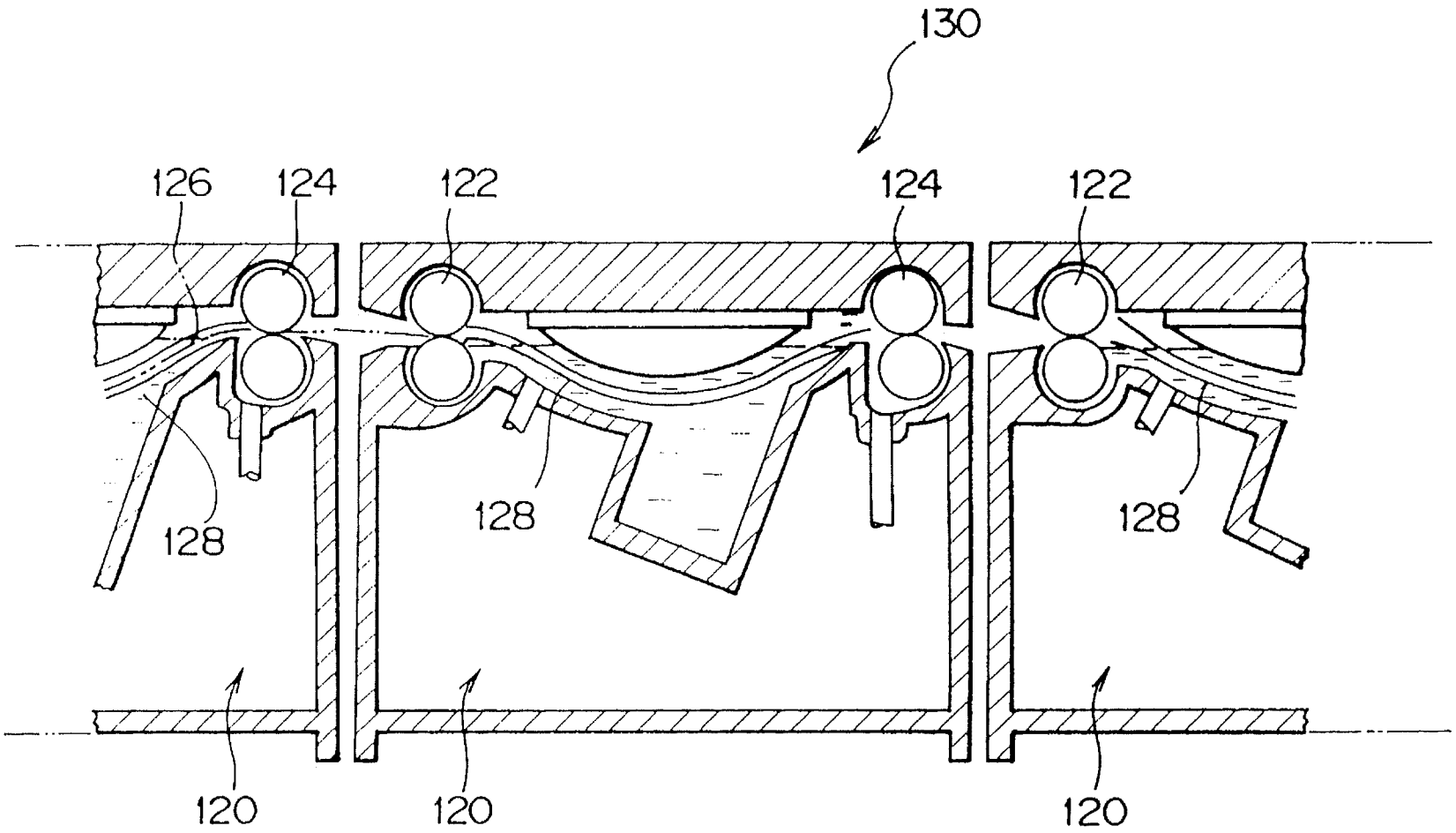
FIG. 8 is a structural view of main portions of an automatic developing apparatus to which the present invention may be applied.
Figure 9A:
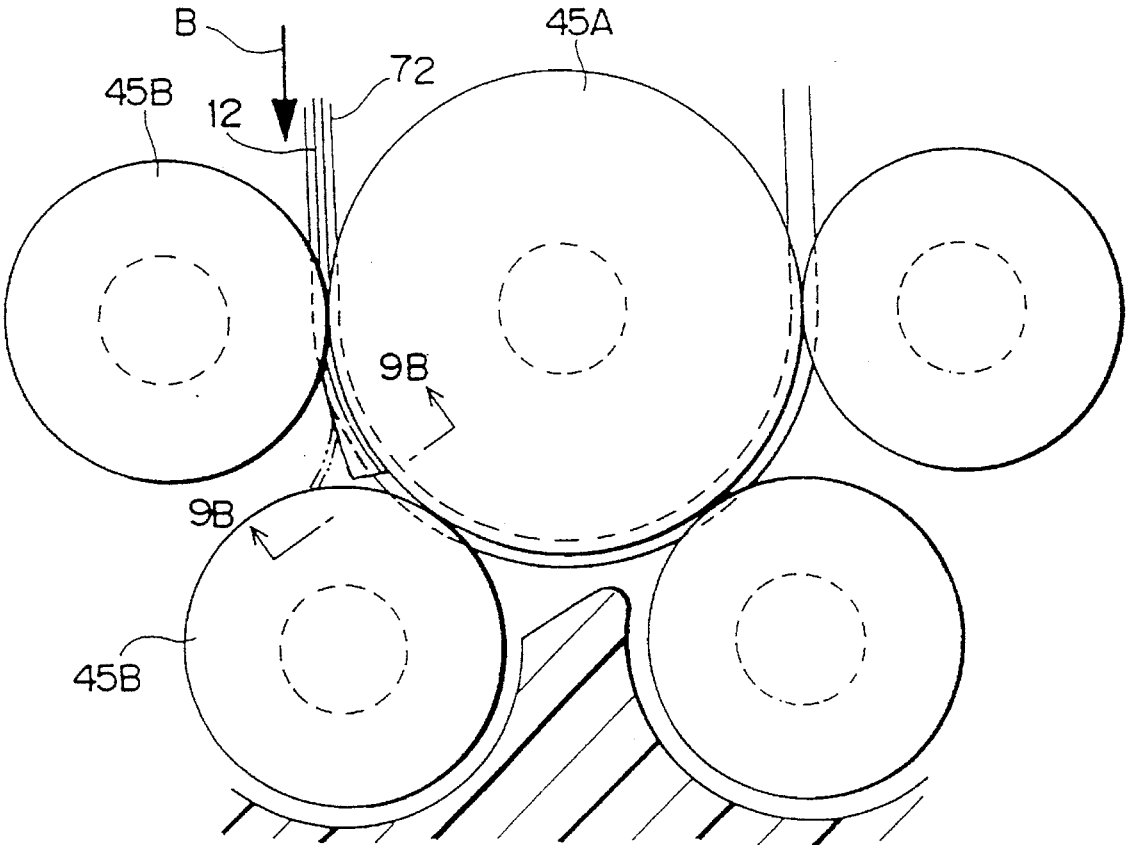
FIG. 9A PRIOR ART
FIG. 9A is a schematic view illustrating conveying of a conventional negative film.
Figure 9B:
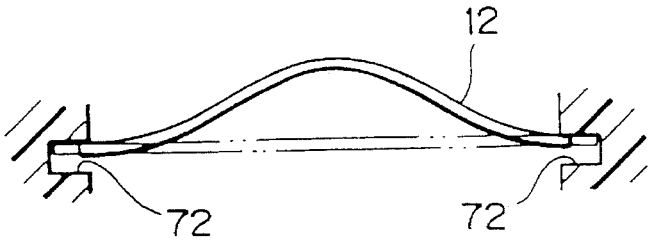
FIG. 9B PRIOR ART
FIG. 9B is a schematic sectional view taken along line 9B—9B of FIG. 9A and illustrating a leading end portion of the negative film.

In the first and second embodiments, the configuration of the leading end of the negative film 12 which can be processed smoothly at the automatic developing apparatus 10 is illustrated by the angled leading end portion 12A and the circular arc shaped leading end portion 12B. However, the configuration of the leading end portion of the negative film 12, which configuration is cut or selected by the photosensitive material processing apparatus of the present invention, is not limited to the above-described configurations. It is preferable that the leading end portion is of a configuration such that at least one transverse direction end portion projects further in the conveying direction than the transverse direction intermediate portion. Recessions and protrusions along the conveying direction may be provided in the leading end provided that the protrusions do not project further in the conveying direction than one transverse direction end.

further, in the above-described embodiments, the automatic developing apparatus 10 is used in which the conveying path is formed such that after the negative film 12 is conveyed substantially downwardly within the processing tank, at the bottom portion of the processing tank, the conveying direction of the negative film 12 is reversed so that the negative film 12 is oriented upward. However, the structures of photosensitive material processing apparatuses to which the present invention may be applied are not limited to the same, for example, as illustrated in FIG. 8, the present invention may be applied to an automatic developing apparatus 130 equipped with so-called shallow processing tanks. In the automatic developing apparatus 130, conveying roller pairs 122, 124 are provided at an upstream portion and a downstream portion of a processing tank 120, respectively. The conveying path is formed by guide grooves 128 and curves both transverse direction end portions of a film 126 within the processing tank 120 such that the transverse direction end portions become slightly convex downwardly, in this case as well, the superior effects of the present invention can be achieved. Note that FIG. 8 illustrates a schematic structure of the processing tank 120 which is a portion of the automatic developing apparatus 130.

In the automatic developing apparatus 130, the film 126 is guided by the guide grooves 128 within the processing tank 120. Even if the transverse direction intermediate portion of the film 126 bulges at the curved portions, the leading end portion of the film 126 is not damaged and the film 126 is conveyed satisfactorily because no rollers are provided. However, it is necessary to curve the conveying path at the portion where the film 126 is delivered to the conveying roller pair 124 which delivers the film 126 out from the processing tank 120 while squeezing the film 126. If the transverse direction intermediate portion of the film 126 bulges greatly at this curved portion, it is easy for the film 126 to be conveyed unsatisfactorily or damaged. Here, if the leading end portion of the film 126 which is being processed is a predetermined configuration, processing can be carried out smoothly without the film 126 being damaged.

further, an automatic developing apparatus which processes the negative film 12 as the photosensitive material is used in the above-described embodiments. However, the present invention may also be applied to a photosensitive material processing apparatus which processes photosensitive materials other than film, for example, photographic printing paper such as color paper or the like.

What is claimed is:

1. A photosensitive material processing apparatus comprising:

a roller which conveys a photosensitive material;

guide grooves, each of said guide grooves being provided at a conveying path transverse direction side of the photosensitive material and guiding a transverse direction end portion of the photosensitive material, the photosensitive material being conveyed by said roller and said guide grooves while being curved by said roller and said guide grooves; and a cutter which, before processing of the photosensitive material begins, cuts the photosensitive material such that at least one transverse direction edge of the photosensitive material projects, in a conveying direction of the photosensitive material, further than a conveying path transverse direction central portion of the photosensitive material.

2. A photosensitive material processing apparatus according to claim 1, wherein said cutter cuts the photosensitive material at a predetermined angle along a transverse direction of the photosensitive material.

3. A photosensitive material processing apparatus according to claim 2, wherein when the width of the photosensitive material is 35 mm, said cutter cuts the photosensitive material such that a distance, in the conveying direction, of an angled portion of a cut portion of the photosensitive material is 5 to 20 mm.

4. A photosensitive material processing apparatus according to claim 2, wherein said cutter cuts the photosensitive material such that perforations formed in the photosensitive material are not cut.

5. A photosensitive material processing apparatus according to claim 1, wherein said cutter cuts the photosensitive material such that a rounded portion is formed on a leading end portion of the photosensitive material, said rounded portion being of a size such that the leading end portion does not protrude out from said guide groove.

6. A photosensitive material processing apparatus according to claim 1, wherein said cutter cuts the photosensitive material such that a circular arc shaped concave portion is formed at a leading end portion of the photosensitive material.

7. A photosensitive material processing apparatus according to claim 6, wherein said cutter cuts the photosensitive material such that rounded portions are formed at leading end portions of the photosensitive material.

8. A photosensitive material processing apparatus according to claim 6, wherein when the width of the photosensitive material is 35 mm, said cutter cuts the photosensitive material such that the depth of the concave portion at a cut portion of the photosensitive material is about 1 to 10 mm.

9. A photosensitive material processing apparatus, comprising:

a roller which conveys a photosensitive material;

guide grooves, each of said guide grooves being provided at a conveying path transverse direction side of the photosensitive material and guiding a transverse direction end portion of the photosensitive material, the photosensitive material being conveyed by said roller and said guide grooves while being curved by said roller and said guide grooves;

a detecting device which detects a configuration of a leading end of the photosensitive material before processing of the photosensitive material begins; and a processing permitting device which permits processing of the photosensitive material only when it is determined, from results of detection by said detecting device, that at least one conveying path transverse direction edge of the leading end of the photosensitive material projects further in a conveying direction of the photosensitive material than a conveying path transverse direction central portion of the photosensitive material.

10. A photosensitive material processing apparatus according to claim 9, wherein in a case in which said processing permitting device permits processing of the photosensitive material, said processing permitting device sends the photosensitive material into a processing portion, and in a case in which said processing permitting device does not permit processing of the photosensitive material, said processing permitting device does not send the photosensitive material into the processing portion.

11. A photosensitive material processing apparatus according to claim 9, wherein said detecting device comprises a first detecting device which detects a transverse direction end portion of the photosensitive material and a second detecting device which detects a transverse direction intermediate portion of the photosensitive material.

12. A photosensitive material processing apparatus according to claim 9, wherein said detecting device detects in detail the configuration of the leading end of the photosensitive material.

13. A photosensitive material processing apparatus according to claim 9, further comprising:

a cutter which, in a case in which said processing permitting device does not permit processing of the photosensitive material, cuts a leading end portion of the photosensitive material such that at least one conveying path transverse direction edge of the leading end of the photosensitive material projects further in the conveying direction of the photosensitive material than the conveying path transverse direction central portion of the photosensitive material.

14. A photosensitive material processing apparatus comprising:

a roller which conveys a photosensitive material;

guide grooves, each of said guide grooves being provided at a conveying path transverse direction side of the photosensitive material and guiding a transverse direction end portion of the photosensitive material, the photosensitive material being conveyed by said roller and said guide grooves while being curved by said roller and said guide grooves;

a detecting device which detects a configuration of a leading end of the photosensitive material before processing of the photosensitive material begins;

a processing permitting device which permits processing of the photosensitive material only when it is determined, from results of detection by said detecting device, that at least one conveying path transverse direction edge of the leading end of the photosensitive material projects further in a conveying direction of the photosensitive material than a conveying path transverse direction central portion of the photosensitive material; and a cutter which, in a case in which said processing permitting device does not permit processing of the photosensitive material, cuts a leading end portion of the photosensitive material such that at least one conveying path transverse direction edge of the leading end of the photosensitive material projects further in the conveying direction of the photosensitive material than the conveying path transverse direction central portion of the photosensitive material.

15. A photosensitive material processing apparatus according to claim 14, wherein said cutter cuts the photosensitive material at a predetermined angle along a transverse direction of the photosensitive material.

16. A photosensitive material processing apparatus according to claim 14, wherein said cutter cuts the photosensitive material such that a rounded portion is formed on a leading end portion of the photosensitive material, said rounded portion being of a size such that the leading end portion does not protrude out from said guide groove.

17. A photosensitive material processing apparatus according to claim 14, wherein said cutter cuts the photosensitive material such that a circular arc shaped concave portion is formed at a leading end portion of the photosensitive material.

18. A photosensitive material processing apparatus according to claim 17, wherein said cutter cuts the photosensitive material such that rounded portions are formed at leading end portions of the photosensitive material.

19. A photosensitive material processing apparatus according to claim 14, wherein in a case in which said processing permitting device permits processing of the photosensitive material, said processing permitting device sends the photosensitive material into a processing portion, and in a case in which said processing permitting device does not permit processing of the photosensitive material, said processing permitting device does not send the photosensitive material into the processing portion.

20. A photosensitive material processing apparatus according to claim 14, wherein said detecting device comprises a first detecting device which detects a transverse direction end portion of the photosensitive material and a second detecting device which detects a transverse direction intermediate portion of the photosensitive material.

* * * * *